US005253866A

United States Patent [19]

Moorman et al.

[11] Patent Number: 5,253,866

[45] Date of Patent: Oct. 19, 1993

[54] BALL WITH A PASSIVE SOUND DEVICE

[75] Inventors: Randall H. Moorman, Georgetown, Mass.; Hansan Ma, Cape Elizabeth, Me.

[73] Assignee: Tonka Corporation, Pawtucket, R.I.

[21] Appl. No.: 731,865

[22] Filed: Jul. 18, 1991

[51] Int. Cl.[5] ..... A63B 43/02

[52] U.S. Cl. ..... 273/65 EE; 273/58 E

[58] Field of Search ..... 446/216, 213, 215, 47; 273/58 E, 55 R, 65 R, 63 A, 65 EE, 65 EF, 65 EG

[56] References Cited

U.S. PATENT DOCUMENTS

| | | | |
|---|---|---|---|
| Re. 33,449 | 11/1990 | Martin | 273/65 EE |
| 186,255 | 1/1877 | Jenkins | 446/215 |
| 495,863 | 4/1893 | Whitzel | 273/58 E |
| 620,087 | 2/1899 | Stein | 273/58 E |
| 1,193,992 | 8/1916 | Cigol | 273/58 E |
| 4,031,655 | 6/1977 | Ponciano et al. | 446/47 |
| 4,291,487 | 9/1981 | Magid | 273/58 E X |
| 4,653,752 | 3/1987 | Miller | 273/60 B |
| 4,674,987 | 6/1987 | Sober | 446/170 |
| 4,801,141 | 1/1989 | Rumsey | 273/58 E X |

FOREIGN PATENT DOCUMENTS

| | | | |
|---|---|---|---|
| 241220 | 7/1946 | Switzerland | 273/63 A |

OTHER PUBLICATIONS

"Aud-A-Ball", Aids & Appliances, America Foundation for the Blind, 18th Ed., Jul. 1972-Jun. 1973.

*Primary Examiner*—Mickey Yu

*Attorney, Agent, or Firm*—Salter, Michaelson & Benson

[57] ABSTRACT

The present invention is a toy sound producing ball, having a ball portion, such as a foam football, joined with a passive sound device, such as a whistle, which produces sound when air travels relative to the sound device, wherein the whistle is joined to the interior or exterior of the ball portion.

19 Claims, 2 Drawing Sheets

BALL WITH A PASSIVE SOUND DEVICE

FIELD OF THE INVENTION

The present invention relates to the field of toys and amusement devices, and more particularly, to toy balls with sound devices.

BACKGROUND OF THE INVENTION

Toy balls have a long history filled with a wide range of inventions for the young as well as the young at heart. Toy balls come in a magnitude of sizes and shapes. Sizes range from small marbles to very large beach balls. Further, balls may be constructed from a variety of different materials. For instance, balls may be made of plastic, wood, and foam, to name just a few.

Sound devices intrigue people of all ages. Curiosity does not end when one reaches any certain age; rather, all ages enjoy the curious nature of sound devices. Throughout the toy industry many manufacturers now incorporate sound devices into toys to add excitement to old toys or to provide a unique spark to new toys. For example, Rumsey, U.S. Pat. No. 4,801,141 discloses a light and sound producing ball in wherein a circuit board controls the light and sound.

The present invention combines the excitement of a sound device and a ball without the need of electrical circuits. Simply passing air relative to the passive sound device generates the tones.

SUMMARY OF THE INVENTION

The present invention is a toy ball with at least one passive sound device. It produces sound when air moves relative to the sound device. Such air movement occurs when the operator kicks or throws the ball. The quality of the sound may be directly dependent on the quality of the throw or kick. The sound device may be either attached to the exterior or interior of the ball. The channel may extend latitudinally, longitudinally, from side to side through the center of the ball, or the channel may extend through the ball without passing through the center. The ball may be elongated, spherical, or any other shape.

A preferred embodiment of the present invention includes a foam football having a latitudinal channel therethrough. The channel comprises a portion of a passive sound making device, an example of which may be a whistle. When the operator throws or kicks the ball, air travels into a sound chamber of the whistle. The air flowing into the sound chamber causes a vibration deviation, which thereby produces sound.

This preferred embodiment is responsive to the skill of the operator. The quality of the sound is dependent on the degree to which an operator can loft the ball into a tight spiral. Naturally, the best quality sound will be produced when an operator lofts a perfect spiral, which signifies the tightest spiral.

The present invention provides an easy operating sound producing ball. The toy ball does not incorporate electrical devices to produce the sound. Rather, the ball operator causes the ball to produce sound when passing it through the air, such as when the operator kicks or throws the ball. Therefore, the toy ball is more convenient than traditional sound producing balls, which may be susceptible to breakage. Also, the ball operator does not need to fuss with batteries or other switches.

DETAILED DESCRIPTION OF THE PREFERRED EMBODIMENT

Figure 1:
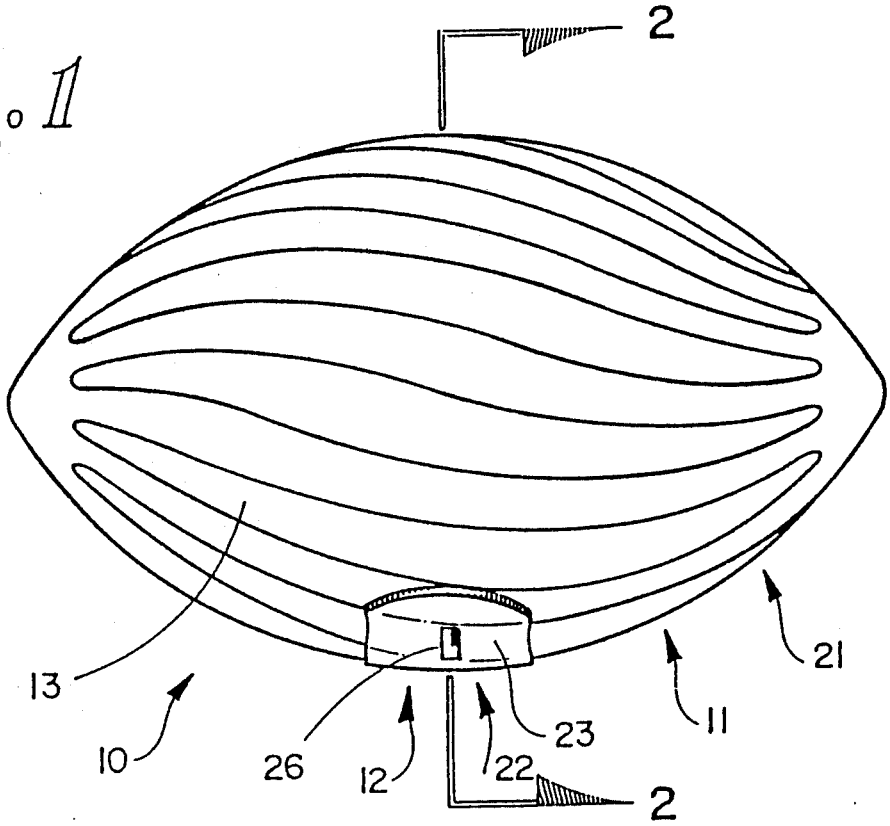
FIG. 1 is a side plan view of the present invention.

FIG. 1 shows a sound producing ball 10 of the present invention which comprises a toy ball portion 11 and a sound device 12. The toy ball portion 11 may be comprised of any of various suitable materials. Preferably the toy ball portion 11 is constructed from polyurethane foam. Other suitable materials include leather, polymers, rubber or any other material from which balls may be constructed.

The toy ball portion 11 may be somewhat shaped like an egg as are the balls used for rugby or football. The toy ball portion 11 may be spherically shaped such as a baseball or a softball. Preferably, the toy ball portion 11 is a football 21 that has grooves 13 as shown. The grooves 13 assist the user in gripping the football 21 for throwing purposes. The toy ball portion 11 must be of a design which is suitable for carrying a passive sound device 12.

The sound device 12 may be joined to the interior or exterior of the toy ball portion 11 in a variety of ways. The following are just a few of the ways. First, the sound device 12 may be integral with the toy ball portion 11 by simply molding the toy ball portion 11 around the sound device 12. Alternatively, the sound device 12 may be attached using adhesive. The sound device 12 may also be snugly, e.g. frictionally received by the toy ball portion 11. The bond formed between the toy ball portion 11 and the sound device 12 must be durable enough to withstand the forces that may be applied to the sound producing ball 10.

Likewise, the sound device 12 must be durable enough to withstand the forces that may be applied to the sound producing ball 10. Preferably, the sound device 12 is also responsive to the user. A sound device 12 that is responsive to the user produces various tone qualities. To be responsive the various tone qualities should be directly dependent on the quality of the throw or kick of the sound producing ball 10.

The sound device 12 is passive. A passive sound device 12 is not augmented by electronic components, but rather takes advantage of air flow around the outer surface of the ball to produce sound. The airflow around the ball 10 is related to the speed with which the ball is propelled through the air. Additionally, the rotation of the ball 10 impacts the speed of the airflow around the ball. As the speed of the ball 10, frequency of the rotations, or both increase the speed of the airflow around the ball increases. The passive sound device 12 uses the airflow around the ball 10 for production of sound. One such sound device 12 is the whistle 22 shown in FIG. 2.

Preferably, the sound device 12 in the football 21 is a whistle 22 comprising a channel 14 and a whistle core structure 16. The channel 14 provides a receiving area for the whistle core 16. Preferably the channel 14 is cylindrical and latitudinally oriented in relation to the main axis of the ball portion 11. However, the channel 14 may be formed in a variety of shapes. In a horizontal cross-sectional plane the channel walls 29, which define the channel 14, could form a triangle, square or any other two dimensional geometric figure. As the number of sides increases, the three dimensional configuration of the channel 14 approaches that of a cylinder. The channel 14 does not have to be latitudinally oriented. In fact, the channel can be oriented longitudinally, diametrically, or the channel 14 may be skewed.

Figure 2:
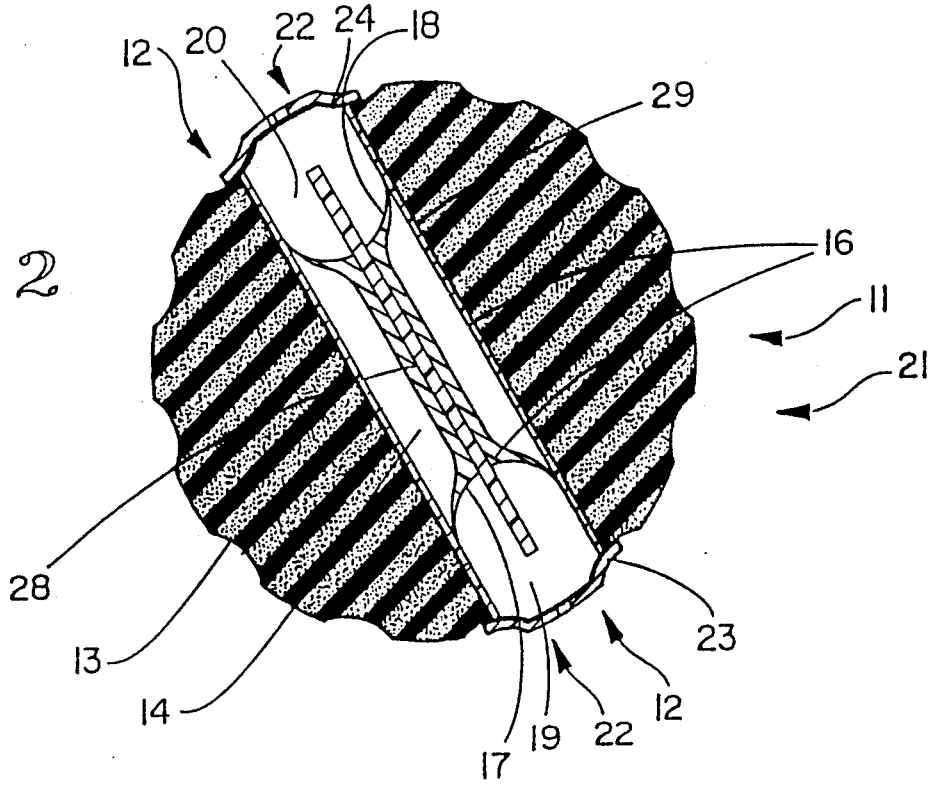
FIG. 2 is a cross sectional view taken along the line 2—2, showing the sound device in a latitudinal channel.

FIG. 2 also demonstrates a suitable shape for the sound device 12 and the position of the whistle core 16 within the channel 13. The whistle core 16 is generally of an hour glass shape. The whistle core 16 defines whistle surfaces 17,18. The whistle surfaces 17,18 in combination with the channel 14 define sound chambers 19,20. The sound chambers 19,20 allow air to travel within the sound device 12 after air enters the sound chambers 19,20.

The outer plates 23,24 of the sound device 12 may extend outward from the surface of the toy ball portion 11. Preferably the outer plates 23,24 are constructed of a pliable material, which bows inward when grasped by fingers. Rod 28 causes the outer plates 23,24 to return to their original extended position once the pressure has been removed. The center of the outer plates 23,24 define two small slot-like airflow openings 26,27 (shown in FIG. 1) respectively. The airflow openings 26,27 provide areas through which air may pass into the sound chambers 19,20. Once air enters the sound device 12, the air travels in a turbulent motion within the sound chambers 19,20, thereby producing sound.

In practice air enters through airflow openings 26,27 defined in outer plates 23,24 respectively. The air travels within sound chambers 19,20 in a turbulent fashion, causing production of sound. If the sound producing ball 10 is constructed as shown in the figures, the quality of the sound is dependent on the quality of the throw. In other words the sound device is responsive to the user. When the football 21 is thrown in a perfect spiral, the overall sound created by the sound producing ball 10 is a unitary tone. When a poor spiral is put on the sound producing ball 10 multiple tones are created by the whistle 22, due to the varying air pressures around the outer plates 23,24.

Figure 3:
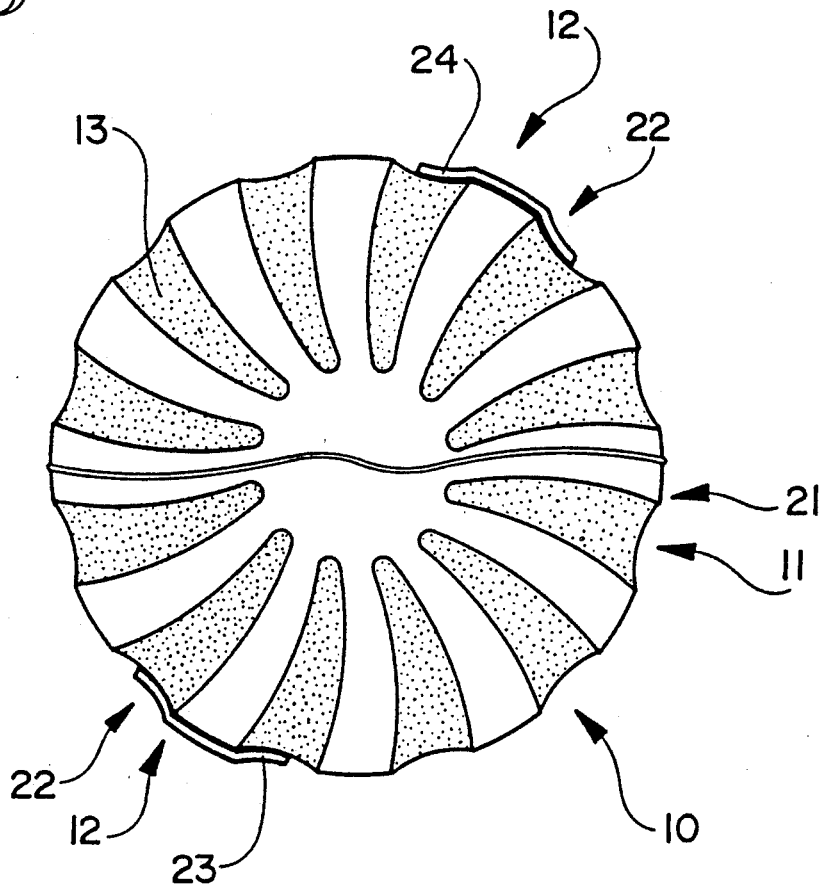
FIG. 3 is a front plan view of the present invention.

FIG. 3 shows a front view of the sound producing ball 10. FIG. 3 shows the placement of the sound device 12 relative to the toy ball portion 11. The whistle core 16 (not shown) is placed in the latitudinal channel 14 (not shown) within the center of the toy ball portion 11. The outer plates 23,24 or shown extending outward from the surface of the sound producing ball 10.

Although the present invention has been described with reference to preferred embodiments, workers skilled in the art will recognize that changes may be made in form and detail without departing from the spirit and scope of the invention.

What is claimed is:

1. A ball comprising a body portion having an outer surface and including a cavity opening outwardly through an opening in said outer surface, said cavity opening a closed inner end, said body portion having first and second ends and a longitudinal axis of rotation extending between said first and second ends, said body portion increasing in diameter from said first end thereof to a midpoint between said first and second ends and then decreasing in diameter to said second end, said cavity defining a sound chamber which is operable for receiving air therein in order to produce a whistling sound when said ball is moved through the air in a spiral rotation.

2. In the ball of claim 1, said cavity being located at a point midway between said ends.

3. In the ball of claim 1, said cavity being disposed in perpendicular relation to said axis of rotation.

4. A football comprising a body portion having first and second ends, a longitudinal axis of rotation extending between said first and second ends, and an outer surface, said body portion increasing in diameter from said first end thereof to a midpoint between said first and second ends and then decreasing in diameter to said second end, said football having a closed ended cavity opening outwardly through an opening in said outer surface, and a plate over said opening having a reduced aperture therein, said cavity and said plate defining a sound chamber which is operable for receiving air therein in a turbulent motion so as to produce a whistling sound when said football is moved through the air in a spiral rotation.

5. In the football of claim 4, said cavity being substantially cylindrical in shape.

6. In the football of claim 4, said aperature being substantially rectangular in shape.

7. In the football of claim 4, said cavity being located at a point midway between the ends of said football.

8. In the football of claim 4, said cavity being disposed in perpendicular relation to said axis of rotation.

9. In the toy of claim 4, said plate comprising a pliable and resilient material.

10. The football of claim 4, further comprising rod means mounted in said cavity for preventing said plate from caving inwardly into said cavity.

11. In the football of claim 4, said recess having a rounded bottom.

12. A football comprising:

a body portion having first and second ends, a longitudinal axis of rotation extending between said first and second ends, said body portion having an outer surface and increasing in diameter from said first end thereof to a midpoint between said first and second ends and then decreasing in diameter to said second end, said body portion having a diametrical channel formed therein in perpendicular relation to said axis, said channel extending through said football and opening outwardly through a pair of diametrically opposed openings in the surface of said football;

core means mounted in said channel and cooperating therewith to define a pair of closed ended cavities in said body portion which open outwardly through said diametrically opposed openings; and a pair of plates over said openings, said plates each having a reduced aperture therein, said cavities and said plates defining a pair of sound chambers which are operable for receiving air therein in a turbulent motion so as to produce a whistling sound when said football is moved through the air in a spiral rotation.

13. In the football of claim 12, said channel being located at a point midway between said ends.

14. In the football of claim 12, said channel being substantially cylindrical in shape.

15. In the football of claim 12, said core means being substantially hourglass in shape.

16. In the football of claim 12, said plate comprising a pliable and resilient material.

17. In the football of claim 12, said apertures being substantially rectangular in shape.

18. The football of claim 12, further comprising rod means mounted in said channel for preventing said plates from caving inwardly into said channel.

19. In the toy of claim 12, said outwardly facing surfaces of said core means being substantially concave and rounded.

* * * * *

UNITED STATES PATENT AND TRADEMARK OFFICE

CERTIFICATE OF CORRECTION

PATENT NO. : 5,253,866

DATED : Oct. 19, 1993

INVENTOR(S) : MOORMAN et al.

It is certified that error appears in the above-identified patent and that said Letters Patent is hereby corrected as shown below:

Claim 1, line 4 (column 3, line 57), change "opening" to --having--.

Signed and Sealed this

Twenty-fourth Day of May, 1994

Bruce Lehman

*Attest:*

BRUCE LEHMAN

*Attesting Officer*

*Commissioner of Patents and Trademarks*